US006041471A

United States Patent [19]

Charky et al.

[11] Patent Number: 6,041,471

[45] Date of Patent: Mar. 28, 2000

[54] MOBILE WALK-BEHIND SWEEPER

[75] Inventors: Gabriel Charky, Dollard des Ormeaux; Jean-Paul Dubois, Terrebonne, both of Canada

[73] Assignee: Madvac International Inc., St. Longuevil, Canada

[21] Appl. No.: 09/057,594

[22] Filed: Apr. 9, 1998

[51] Int. Cl.[7] ..... A47L 7/00; A47L 9/10

[52] U.S. Cl. ..... 15/320; 15/340.4; 15/352

[58] Field of Search ..... 15/320, 347, 352, 15/383, 340.2, 340.4

[56] References Cited

U.S. PATENT DOCUMENTS

| | | | |
|---|---|---|---|
| 1,829,582 | 10/1931 | Carson | 15/347 |
| 3,977,039 | 8/1976 | Block | 15/347 |
| 4,467,494 | 8/1984 | Jones | 15/352 |
| 4,554,701 | 11/1985 | Van Raaij | 15/347 |
| 4,580,313 | 4/1986 | Biehert | 15/349 |
| 5,058,235 | 10/1991 | Charky | 15/340.1 |
| 5,426,805 | 6/1995 | Fisher | 15/79.2 |

FOREIGN PATENT DOCUMENTS 949707 6/1974 Canada .

*Primary Examiner*—Robert J. Warden, Sr.
*Assistant Examiner*—Theresa T. Snider
*Attorney, Agent, or Firm*—Sim & McBurney

[57] ABSTRACT

The present invention provides a walk-behind mobile sweeper for cleaning dust and collecting garbage from surfaces. The sweeper has a motorized cart maneuverable by a human operator, a flow-through collection apparatus supported on the cart for collecting garbage therein, a suction inlet located forwardly of the collection apparatus and a vacuum blower for creating air suction, the vacuum blower drawing garbage and dust via suction through the suction inlet and into the collection apparatus, wherein the vacuum blower is positioned downstream of the container such that garbage does not enter the vacuum blower. The walk-behind mobile sweeper is easily maneuverable, is compact and not only cleans dust and dirt from surfaces but also collects garbage which is further compacted or compressed within a bag. The sweeper can be configured not only as a walk-behind sweeper but also as a stand-on skateboard sweeper or as a ride-on sweeper.

16 Claims, 7 Drawing Sheets

MOBILE WALK-BEHIND SWEEPER

FIELD OF THE INVENTION

This invention relates in general to sweepers for sweeping walkways, and more particularly the invention provides a mobile walk-behind sweeper useful for cleaning dirt and for collecting debris from sidewalks, laneways and roadways. The present invention also relates to a filtration system for use in sweepers.

BACKGROUND OF THE INVENTION

The maintenance of the cleanliness of roadways land walkways has typically been done by personnel using various types of equipment to collect debris and garbage. Initially, debris and garbage was collected manuauly. Over time, various types of devices were developed in order to motorize to job to make such collection easier, faster and overall, more efficient.

Canadian patent 949,707 discloses a motorized mobile vacuum trash collector. The collector comprises a pivoted cylindrical bin mounted to a fame connected to a motorized cart. A retractable lid for the bin is connected to the frame via a spring loaded rangement and is surmounted by a vacuum blower. A flexible hose is supported over an operator's head extending from the frame, with one end of the hose being connected to the lid while the other end is connected to the nozzle. The trash collector is driven like a cart and suffers from the disadvantage that the operator is required to frequently empty the bag of collected trash, or periodically manually compress or compact the trash to allow additional trash to be collected.

U.S. Pat. No. 5,058,235 also discloses a mobile vacuum trash collector which comprises a motorized cart, a frame connected rearwardly to the cart, a bin mounted to the frame, a lid removably connected to the bin and a flexible hose connected to the lid at one end and having a nozzle at the other end. This mobile ash collector has an air permeable bag for collecting the trash which allows for a large quantity of debris to be sucked into the bag and compressed or compacted.

While both of these prior art mobile vacuum ash collectors provide for the collection of garbage, their design is very large and not that easy to maneuver around pedestrians particularly on narrower sidewalks as well as for use in large commercial locations such as airports, amusement parks, shopping malls or warehouses. Furthermore, they do not provide any capacity for the cleaning and filtering of dust and dirt from sidewalks or floors, but rather act to pick up debris and larger garbage.

Sweepers have thus been designed which are smaller and more easy to maneuver than the conventional driven motorized types of garbage collectors and more specifically act not only to collect garbage but also to sweep or clean dirt and dust from the walkways and hard to reach locations where motorized cart do not have easy access. U.S. Pat. No. 4,580,313 discloses a walk behind floor maintenance machine which includes a filter and filter housing that is pivotedly mounted to permit removal of the debris hopper. The filter is cleaned by the vibration of the filter and filter housing which then slides into a hopper. Finally, the hopper is manually removable for emptying.

U.S. Pat. No. 5,426,805 discloses a walk-behind self-propelled sweeper which comprises a main frame including a base portion and a handle portion. A pair of wheels is secured to the base portion for engaging the ground surface, an engine mounted on the base portion, a hydraulic pump carried on the base portion and operably connected to the engine, a first hydraulic motor coupled to the wheels and connected to the hydraulic pump and a second hydraulic motor coupled to the hydraulic pump and connected to an attachment secured to the base portion. Handgrips are provided to operate valves for release of fluid to the respective motors. While such a device does provide for the sweeping of sidewalk and floors, it suffers from the disadvantage that the sweeper is loud, rather clunisy to operate and does not provide for the cleaning of dirt and dust from the surface of floors and walkways without creating dust and also does not allow the simultaneous collection of trash together with dirt and dust.

A walk behind sweeper has been designed and sold by Applied Sweepers Inc. This sweeper can be used either as a walk-behind or as a ride-on and collects garbage and dust by sucking such through a fan system and into a collection means within the sweeper. Another walk behind sweeper is also provided by DANLINE International Ltd. in which garbage and dust is swept through a fin system and into a collection means. While both of these sweepers can be used for cleaning roadways and walkways, they suffer from the disadvantage that large garbage items can damage the fan as they are drawn into and through the fan system prior to collection in a collection bin. This may causes a great deal of damage and wear and tear on the fan system. In addition, garbage can get stuck in the fan system. This limits the types of garbage that can be collected and also increases the work required by the operator. For example, large pieces of wood or metal cannot be collected by suction into the sweeper and must instead be collected by hand. Also, the litter is not compacted within the container and must be frequently compacted or emptied. Furthermore, the sweepers utilize large amounts of water to suppress dust and therefore require large reservoirs of water and as a result, may leave behind mud on swept surfaces.

There is therefore a need to develop a mobile walk-behind sweeper which obviates at least one problem associated with the sweepers of the prior art and can be used to collect all types of garbage and dirt. There is also a need to develop a filtration system which can be utilized in various sweepers to collect dust and help to control dust emission during sweeping and cleaning.

SUMMARY OF THE INVENTION

According to the present invention, a walk-behind mobile sweeper is provided which provides for easy maneuverability for negotiating obstacles and in particular people. The walk-behind mobile sweeper of the present invention is compact and not only cleans dust and dirt from surfaces but also collects garbage which is compacted or compressed within a bag. The garbage is collected utilizing straight-through suction without the garbage passing through the fan which provides additional safety features as well as provides for the compact collection of garbage without the constant need for emptying of the collection receptacle. The sweeper can be configured not only as a walk-behind sweeper but also as a stand-on skateboard sweeper or as a ride-on sweeper.

Additionally, the walk-behind sweeper sweeps and draws dust into and through a filtration system so that dusty air does not travel through the fan system and consequently be expelled into the environment. This also obviates the need for frequently cleaning the fan system. The filtration system also suppresses the spreading of dust and fine particles without the use of large quantities of water and thus does not form mud puddles on swept surfaces. Such a system can be used not only in a walk-behind sweeper, but also with a motorized cart garbage collector.

According to an object of the present invention there is provided a walk-behind mobile sweeper for cleaning dust and collecting garbage from surfaces, the sweeper comprising; a motorized cart maneuverable by a human operator; a flow-through collection means supported on the cart for collecting garbage therein, a suction inlet means located forwardly of said collection means and a vacuum blower for creating air suction, the vacuum blower drawing garbage and dust via suction through the suction inlet means and into the collection means, wherein the vacuum blower is positioned downstream of the container such that garbage does not enter the vacuum blower. In one embodiment, a filtration system is located adjacent said collection means for filtering and collecting dust drawn into said collection means and to prevent dust from entering the vacuum blower.

Preferably the collection means comprises a perforated basket supported within a container. Most preferably, an air permeable bag or liner is provided within the basket to collect the garbage making it easier to dispose of. The perforated basket and the air permeable bag or liner allow air under vacuum to draw garage into and to the bottom of the bag and acts to help compact the collected garbage. Also, a filtering system is provided for filtering dust and dirt from the air and preventing it from entering the blowing means.

The sweeper of the present invention is designed to allow for easy hands-on maneuverability in a stable and compact sweeper design. The design allows for easy sweeping of hard to reach areas that traditional garbage collectors cannot access. In addition, the sweeper is easy to operate without excessive noise.

In accordance with another object of the present invention is a filtration system for use in sweeping and garbage collecting devices, the filtration system comprising; a container having an inlet for the introduction of dirt and garbage, a vacuum blower for drawing garbage, dust and dirt into said container, and a filtration means for collecting and filtering dust and dirt. The filtration system can be utilized in a variety of different types of cleaning devices such as the walk-behind sweeper of the present invention, in a skate board type of sweeper, or a ride-on design of sweeper.

In accordance with another object of the present invention is a filtration system comprising a container having an inlet for the introduction of dirt and garbage therein, a vacuum blower for drawing garbage and dirt into said container via suction and a filtration means for filtering and collecting the dirt suctioned into said container. Preferably, the container has a perforated basket supported therein for collecting garbage and the filtration means comprises a filter positioned within the container spaced apart from the basket and the container, the spaces distributing suction around the basket and the filter, wherein the dirt suctioned into the container is suctioned through and trapped and collected within the filter.

The filtration system may be incorporated into different types of trash collectors such as those comprising a motored cart for copying a human operator or walk-behind sweepers.

DETAILED DESCRIPTION OF THE DRAWING

These and other advantages of the invention will be, better understood with reference to the detailed description below in conjunction with the following drawings, in which.

Figure 1:
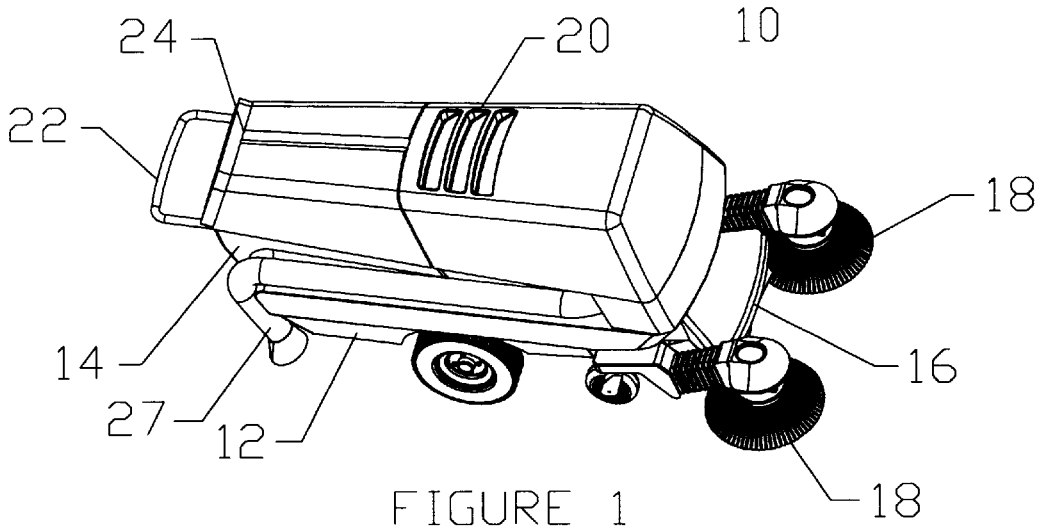
FIG. 1 is a side perspective view of the mobile walk-behind sweeper in accordance with the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

Figure 2:
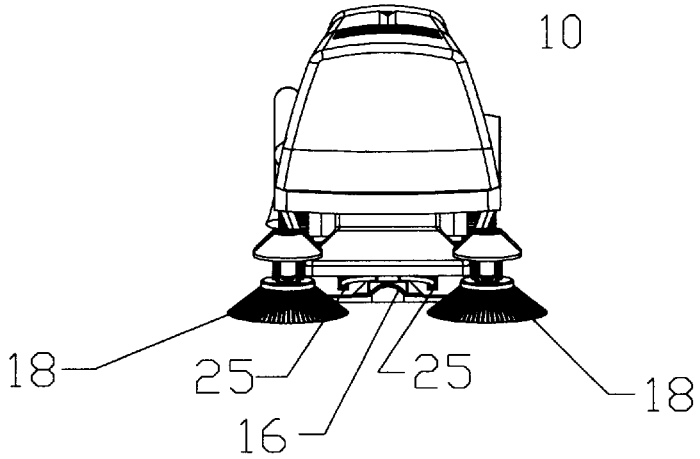
FIG. 2 is a front elevational view of the sweeper of FIG. 1.
Figure 3:
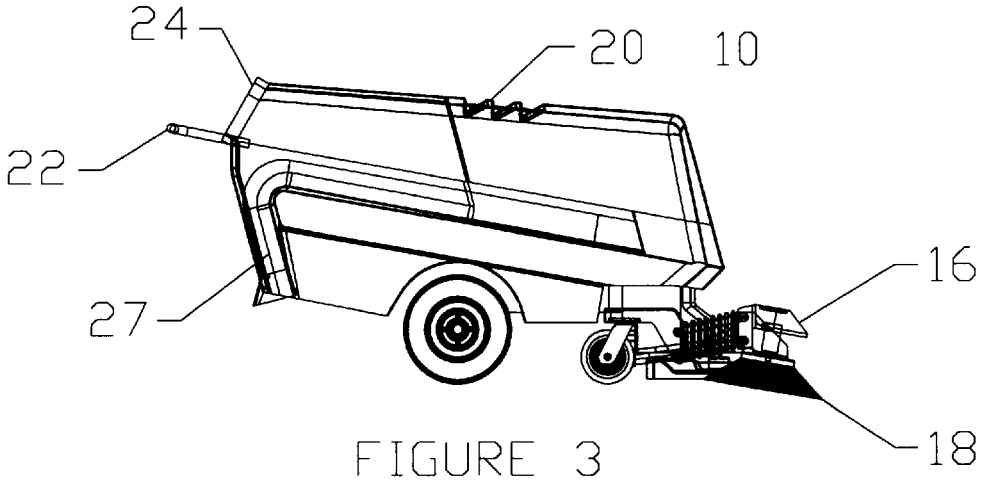
FIG. 3 is a side elevational view of the sweeper of FIG. 1.

With reference to FIGS. 1 to 3, a mobile walk-behind sweeper is illustrated and generally indicated by reference numeral 10. The sweeper 10 comprises a motorized cart 12, such as a small four-wheeled cart powered by a diesel engine to which is secured an appropriately sized fiberglass frame 14. A suction device 16 is mounted to the front of the frame 14 to which a pair of self-leveling brushes 18 are mounted. Exhaust vents 20 are provided on the top of the frame 14 and allows air suctioned through the suction device and through the sweeper, to be expelled into the atmosphere. The sweeper 10 has a handlebar 22 mounted on the rear end of the sweeper for easy steering of the sweeper as well as a control panel 24 for controlling operation of the sweeper.

A water system is provided for pumping water through spray jets 25 located in front of the brushes 18. Water is supplied by water tanks balanced on the center of gravity of the sweeper. Preferably, the water tans hold approximately 12.5 US gallons of water. A hose attachment 27 is also attached to one side of the frame for vacuuming enclosed areas such as bus shelter, tree wells, between parked cars etc.

Figure 4:
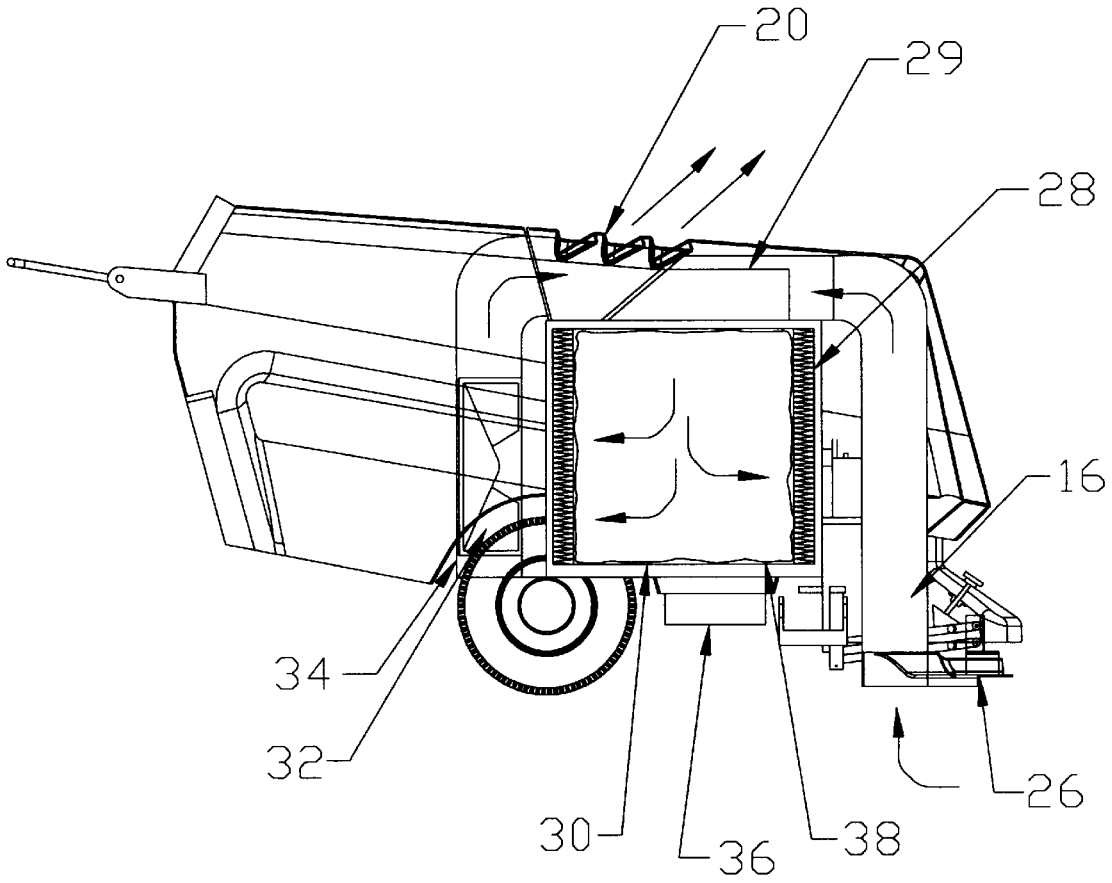
FIG. 4 is a cross-sectional view of the sweeper taken along the line A—A of FIG. 3.

As illustrated in FIG. 4, the sweeper has a suction nozzle 26 attached to the bottom of the suction device 16 through which garbage and, dirt is drawn into and through the device to the top of a container 28 and into a perforated basket 30 which supports an air-permeable bag 38 within the basket. Preferably, the perforated basket is perforated on all sides and on the bottom. The container 28 has a container cover 29 for easy opening and removal of the bag 38 containing compacted or compressed garbage. Suction is provided by an engine powered fan 32 enclosed within a fan casing 34 located rearwardly of the suction device 16 and the container 28. A dust bucket 36 is provided beneath the bottom of the perforated basket 30 to collect dust and dirt particles. It is understood by those skilled in the art, that while a perforated bag is shown to collect the garbage, any suitable type of air-permeable collection device can be used such as a liner.

Figure 5:
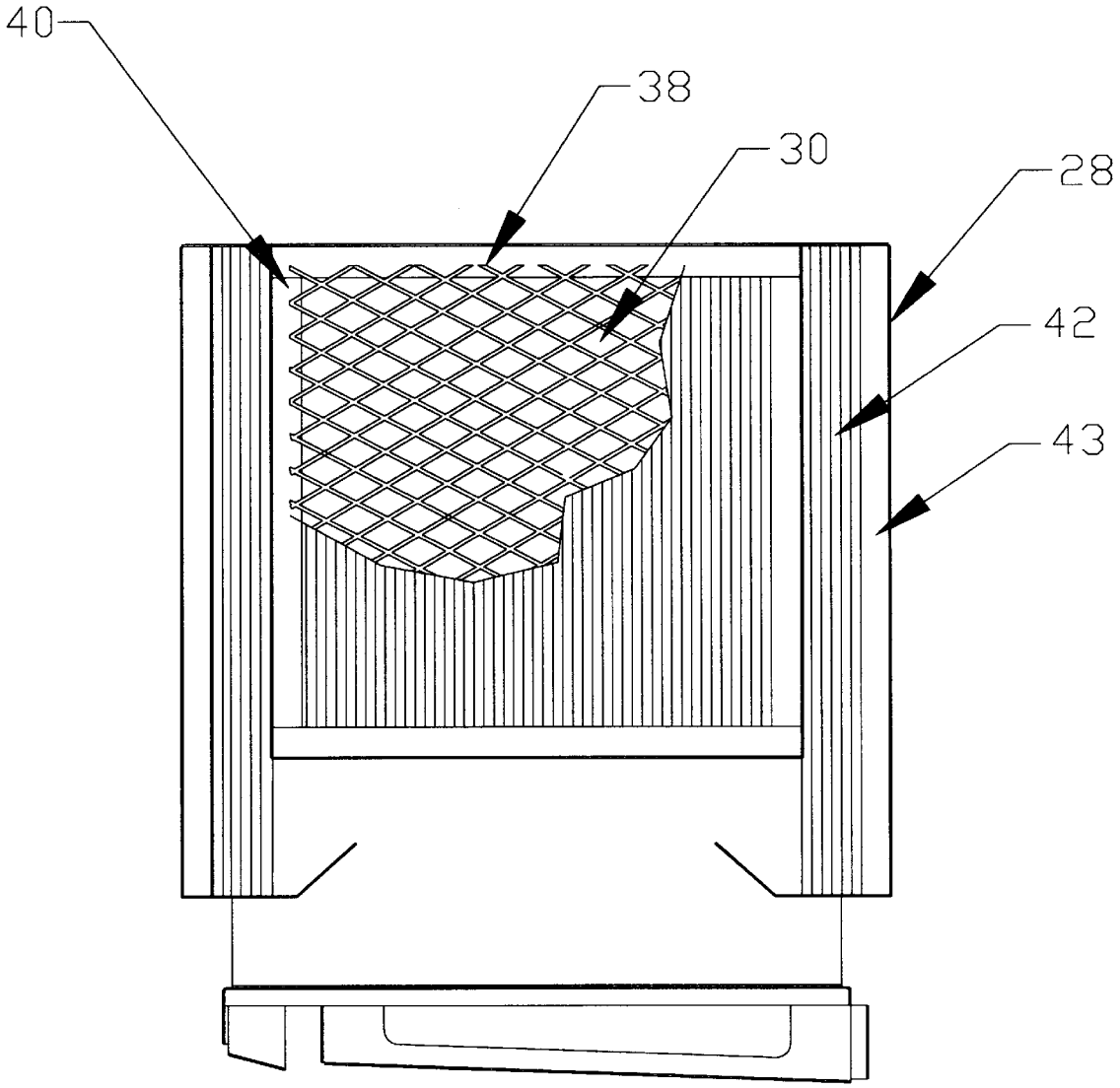
FIG. 5 is a partial vertical cross-sectional and enlarged view of the container used in the sweeper taken along the line A—A of FIG. 3.

Referring to FIG. 5, the inside of the container 28 is shown in greater detail comprising the perforated basket 30 made from a suitable material such as aluminum or steel etc., for supporting the air-permeable bag 38 within the basket. A first air gap space 40 is provided between the air-permeable bag and the perforated basket. This allows for air to be distributed all around the air-permeable bag such that air will continue to circulate even if a portion of the bag becomes clogged with debris. A filter 42 is provided substantially adjacent to the basket. Between the filter 42 and the container 28 is provided a second air gap 43 which allows air to distribute all around the filters such that air will continue to circulate around the filters even if a portion of the filters should become clogged wit dirt and dust.

Figure 6:
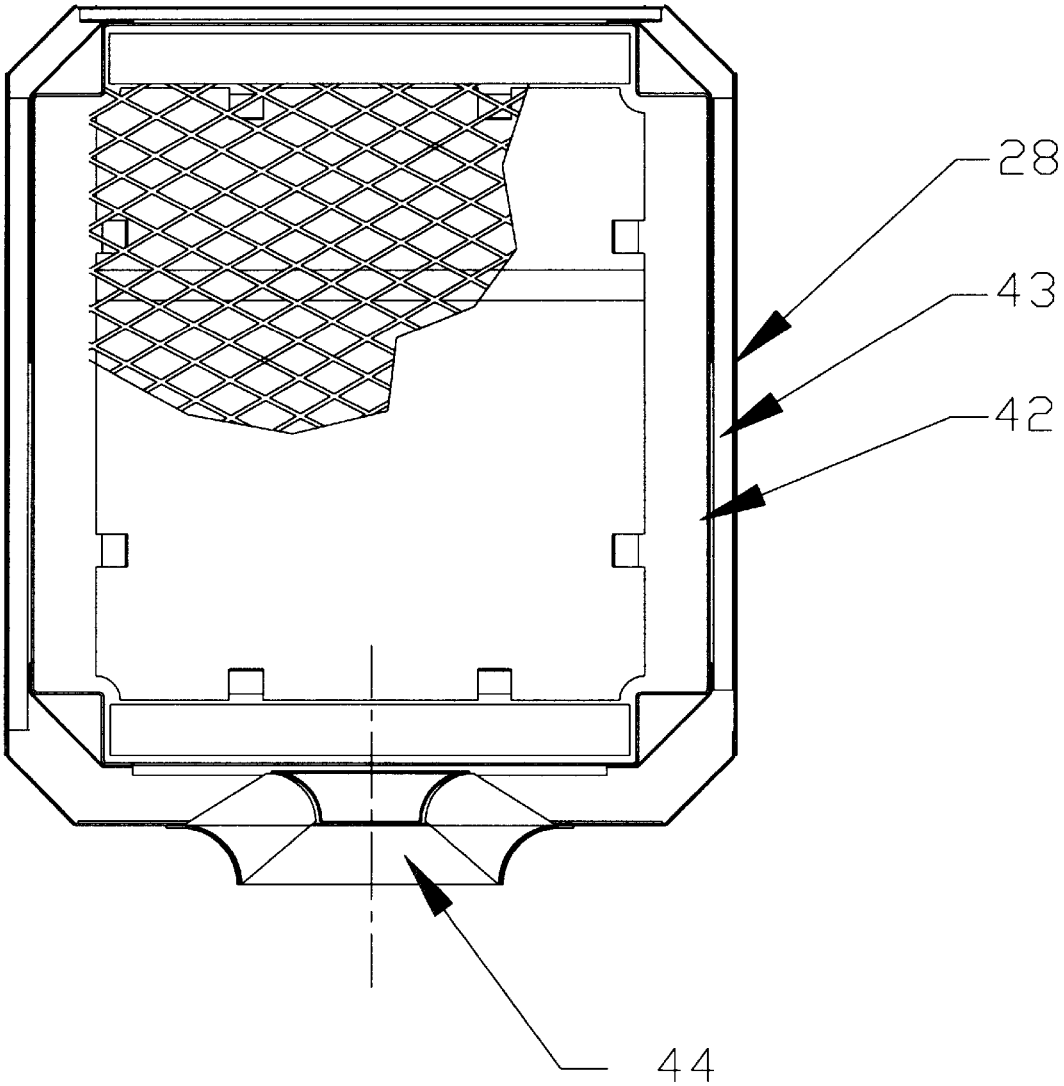
FIG. 6 is a partial top cross-sectional and enlarged view of the container used in the sweeper taken along the line B—B of FIG. 2.

As better seen in FIG. 6, the filter 42 essentially completely surrounds the basket on all four sides. The filter also filters the air being drawn towards the outlet 44 to the fan location. Preferably, the filters are quick change reusable polyester panel filters which provide an increased filtration surface area. The panels of the filters are also preferably pleated which tremendously increases filtration surface area such that the air which moves through the fan is essentially free of dust and dirt. Compared with exhaust bags of the prior at which only provide about 8 to 10 $ft^2$ of filtering surface area, the filters of the present invention provide up to about 300 $ft^2$ of filtering surface area. This helps to decrease any dust or dirt emissions from the exhaust 20 of the sweeper. In addition, the large surface area of the filter means that the filters do not need to be changed frequently as the filter can adsorb a large amount of dirt and dust. Furthermore, the filters of the present invention allow only about 3 to 10 ft/min of air speed due to the dense filtration area, whereas exhaust bags of the prior art provide about 150 to 200 ft/min of air speed. The decrease in air speed provides for a much greater amount of filtration of dust and dirt from the air.

In option, an operator controls the sweeper via the use of the control panel and maneuvers the sweeper via the handlebar to pick up debris such as discarded paper, bottles, cans, etc., from sidewalks, lawns, roads, floors etc. Larger garbage items are directly sucked into the air-permeable bag within the perforated basket via the suction device. The suction created by the fans acts to suck the garbage to the bottom of the bag and also helps to compact the garbage within the bag. This allows for more garbage to be collected with less frequency that the container must be opened and emptied. It also reduces the number of bags used for collecting garbage. The operator may also actuate the water spray jets located in front of the brushes via the control panel in order to wash soiled areas with water or disinfectant. Additionally, spraying water through the water jets may also decrease the amount of. dust produced by the brushes.

The dust and dirt is directed through the suction nozzle and travels up the suction device and into the air-permeable bag. The vacuum blower or fan creates sufficient air suction to draw the dust and dirt into the filter located within the air gap. The dust and dirt trapped in the filters can be agitated when the sweeper is not in use causing the excess dust and dirt to fall from the filter and into a dust bucket. A filter vibrator can be provided on the sweeper for this purpose. The dust bucket can then be removed and cleaned as required. The filters may also be removed and cleaned or replaced as required.

As garbage and dust is not drawn into the fan system of the present invention, the sweeper is not limited to the collection of only certain types of garbage. The sweeper can collect large pieces of wood, metal, etc. safely and efficiently without any damage to the fan system or having any types of garbage be stuck within the fan system.

The fan 32 is powered and closely disposed to the engine. The engine is preferably a liquid cooled diesel engine having a start-stop-glow ignition switch, a 2.5 U.S. gallon fuel tank, a 12 V, 480 W alternator and electrical shutdown capacity.

The control panel components may include several gauges for indicating field level, hour meter, oil pressure indicator, water temperature and voltmeter. Other features may also include a throttle lever, switches for headlights, flashing lights, vacuum fan, brushes, water spraying and horn. Finally, there may be provided an emergency shutdown button.

The sweeper of the present invention is preferably a all hydraulic drive, variable displacement piston pump with infinitely variable speed in both forward and reverse directions. The larger 16 inch diameter wheels are driven by hydraulic motors, whereas the two smaller 8 inch diameter wheels are castor wheels. A safety switch is provided to prevent the engine from starting if the traction pump is not in neutral position. The sweeper can attain speeds of from 0 to about 6.25 mph and has a hydrostatic transmission braking system and a hand-operated independent disc brake on each drive wheel with full park-brake capabilities.

The mobile walk-behind sweeper of the present invention may optionally be designed to have a dog excrement system comprising a special vacuum hose for spraying disinfectant and directing excrement into a separate stainless steel chamber within the sweeper that can be emptied and disinfected as required.

While the mobile sweeper of the present invention is provided as a walk-behind type of sweeper, it is also understood by those skilled in the art that the sweeper can be made as a stand-on skateboard type of sweeper with an easy stow away system, or alternatively, with a ride-on seat with adjustable seat position and easy stow away system.

Figure 7:
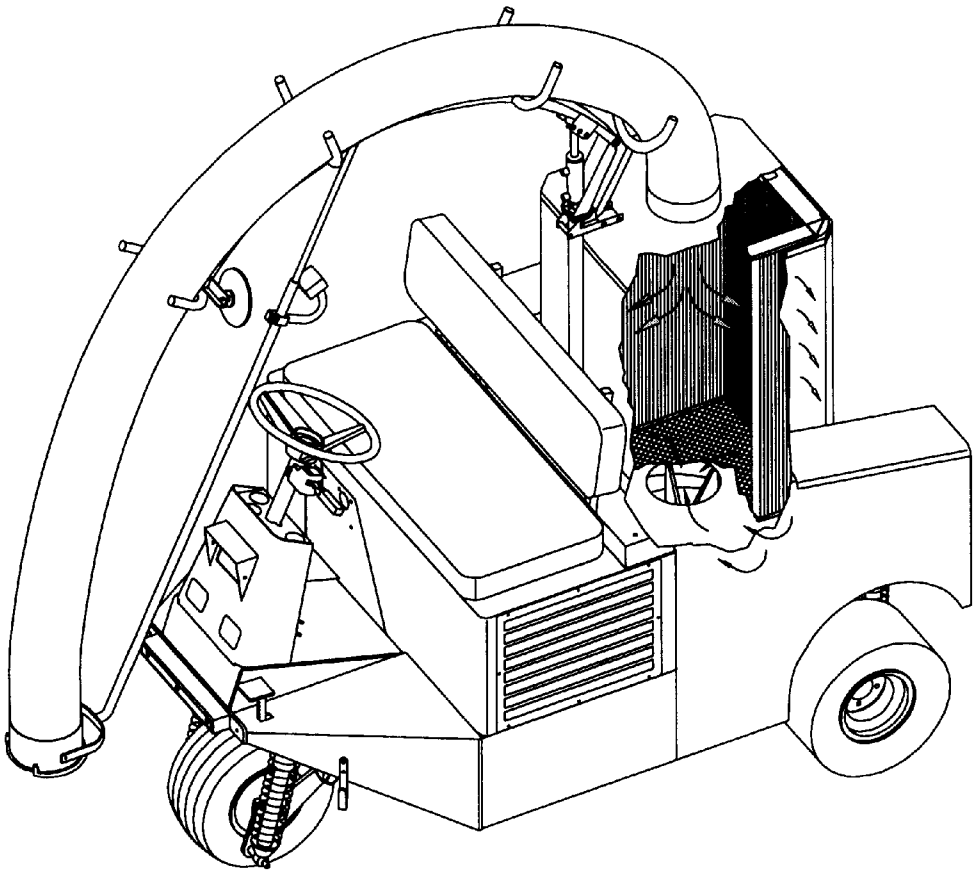
FIG. 7 is a perspective and partially cut-away view of the filtration system of the present invention as incorporated in a motorized garbage collector in accordance with another embodiment of the present invention.
Figure 8:
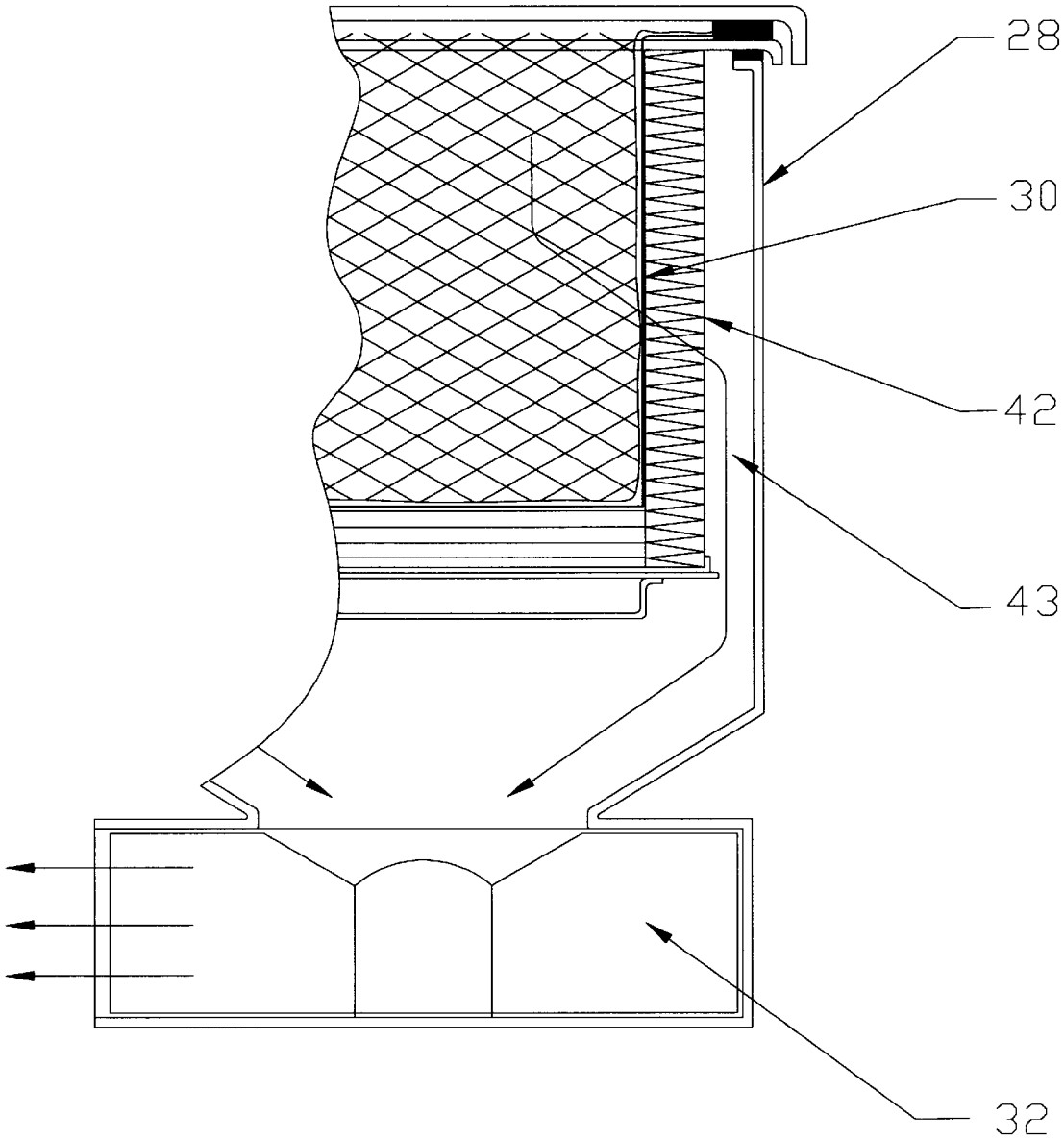
FIG. 8 is an enlarged cross-sectional side view of the filtration system of FIG. 7.

As seen in FIG. 7, the flow-through garbage collection and filtration system can be incorporated into a motorized cart type of garbage collector. In this embodiment, the garbage, dust and dirt is drawn directly into the air-permeable bag supported within the perforated basket of a container via an inlet of a large hose. As better seen in FIG. 8, the fan is located directly beneath the perforated basket and acts to create a downward suction to collect and compact garbage inside of the container 28. The perforated basket 30 supports the air-permeable bag 38 within the basket. Between the air perforated bag 38 and the basket 30 is an air gap space 40 which allows air flow around the entire air-permeable bag. A filter 42 is provided substantially adjacent to the basket which acts to tap dust And dirt in the air being circulated therein. A second air gap space 43 is provided between the filter and the container. Both air gap spaces act to distribute the vacuum all around the airpermeable bag and the filter. The filter 42 essentially completely surrounds the basket on all four sides. The filter also filters the air being drawn towards the outlet 44 to the fan location.

Figure 9:
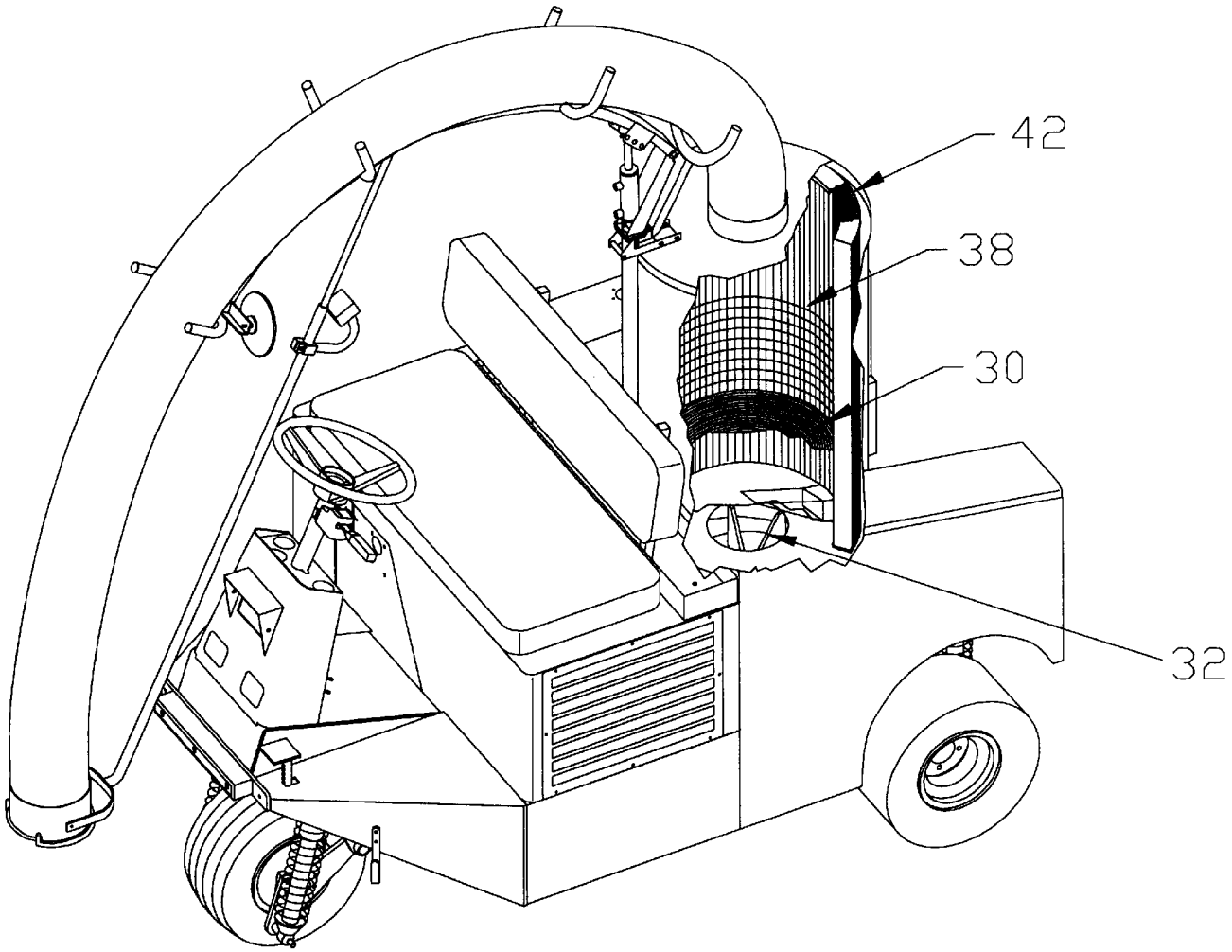
FIG. 9 is a perspective and partially cut-away view of another embodiment of the filtration system of the present invention as incorporated in a motorized garbage collector.

Another embodiment of the filtration system is shown in FIG. 9 where a round container having a round perforated basket is shown as mounted to a motorized cart garbage collector. In this embodiment, the filter provided is also cylindrical in shape and is located adjacent the basket and the container to collect dust and dirt. Air gap spaces are also provided in this cylindrical filter configuration. It is understood by those skilled in the art that the fan, container, perforated basket and filter which comprise the filtration system of the present invention can be configured in several different ways and adapted for use in various types of garbage collection devices and sweepers.

In summary, both the filtration system and the mobile sweeper of the present invention provide for high performance cleaning. The mobile walk-behind sweeper of the present invention provides high performance cleaning utilizing a low noise vacuum system. The straight through suction of the vacuum system provides for garbage to be directly compacted within a disposable bag without the garbage passing through the fan system which would be noisy and potentially dangerous. It would also decrease the efficiency of the fan system and lead to potential breakdown of the system. While the fan system of the present invention is shown to be located directly rearward of the container, it is understood by those skilled in the art that the fan system may be located in other positions relative to the container so long as the fan system and the straight through collection of garbage is not altered.

The vacuum system may also include a dust filter system which allows for the collection of large quantities of dirt with negligent emission of fine particles. This is especially advantageous when the sweeper is used around pedestrians. The dust is filtered and collected so that minimal amounts enter the fan system to impede its function. In addition, the sweeper does not utilize large volumes of water to control dust emission and therefore does not leave behind any mud on surfaces. It is understood that the dust filtration system of the present invention can be adapted for use in several different types of cleaning devices including walk-behind sweepers, skate-board designed sweepers, ride-on designed sweepers, or different motorized cart garbage collectors.

The sweeper of the present invention is relatively compact and lightweight making it easy to maneuver and control allowing the operator to precisely control the cleaning procedure. This is especially important for the cleaning of smaller confined areas which traditional garbage collection carts cannot access. Although preferred embodiments have been described herein in detail, it is understood by those skilled in the art that variations may be made thereto without departing from the scope of the invention or the spirit of the appended claims.

We claim:

1. A mobile sweeper for cleaning dust and collecting garbage from surfaces, said sweeper comprising;

a motorized cart maneuverable by a human operator;

a flow-through collection means supported on the cart for collecting garbage therein;

suction inlet means located upstream of said collection means;

a plurality of brushes mounted forwardly to said suction inlet means to clean and direct dust into the suction inlet means;

a vacuum blower for creating air suction, said vacuum blower drawing garbage and dust via air suction through said suction inlet means and into said collection means, wherein the vacuum blower is positioned downstream of said collection means such that garbage does not enter the vacuum blower; and a filtration means located adjacent said collection means for filtering dust drawn into said collection means and to prevent dust from entering the vacuum blower.

2. The sweeper of claim 1, wherein said sweeper additionally comprises water spray jets positioned in front of said brushes and a water reservoir operably connected to said jets.

3. The sweeper of claim 1, wherein said collection means comprises a perforated basket supported within a container.

4. The sweeper of claim 3, wherein an air permeable bag or liner is provided within the basket to contain garbage.

5. The sweeper of claim 3, wherein there is provided at least one air gap between the perforated basket and the container to allow for the circulation of air through said filtration means.

6. The sweeper of claim 1, wherein said suction inlet means comprises a suction tube having an inlet at one end for drawing in dust and garbage, and an outlet at the other end.

7. The sweeper of claim 1, wherein said filtration means comprises a plurality of filter panels positioned substantially around all sides of the collection means, said panels entrapping dust contained within the air drawn in from the vacuum blower.

8. The sweeper of claim 7, wherein said filter panels are selected from square shaped, rectangular and cylindrical.

9. sweeper of claim 8, wherein said filter panels are pleated.

10. The sweeper of claim 9, wherein said filter panels are made of polyester and are reusable.

11. The sweeper of claim 1, wherein said sweeper is adapted as a walk-behind sweeper.

12. The sweeper of claim 1, wherein said sweeper is adapted as a stand-on skateboard sweeper.

13. The sweeper of claim 1, wherein said sweeper is adapted as a ride-on sweeper.

14. A mobile sweeper for cleaning dust and collecting garbage from surfaces, said sweeper comprising;

a motorized cart maneuverable by a human operator;

a perforated basket supported within a container and supported on the cart for collecting garbage therein;

suction inlet means located upstream of said collection means;

at least one vacuum nozzle mounted upstream to said suction inlet means to clean and direct dust into the suction inlet means;

a vacuum blower for creating air suction, said vacuum blower drawing garbage and dust via air suction through said suction inlet means and into said perforated basket, wherein the vacuum blower is positioned downstream of said perforated basket such that garbage does not enter the vacuum blower; and a filtration means positioned substantially adjacent said container for filtering dust drawn into said perforated basket and to prevent dust from entering the vacuum blower.

15. The sweeper of claim 14, wherein said filtration means comprises one continuous filter panel positioned substantially around all sides of the perforated basket for filtering dust drawn into said perforated basket and to prevent dust from entering the vacuum blower.

16. The sweeper of claim 15, wherein said filtration means comprises a plurality of filter panels positioned substantially around all sides of the perforated basket for filtering dust drawn into said perforated basket and to prevent dust from entering the vacuum blower.

* * * * *